US006267308B1

(12) United States Patent
Hall

(10) Patent No.: US 6,267,308 B1
(45) Date of Patent: Jul. 31, 2001

(54) CURB CLEANER NOZZLE ASSEMBLY

(76) Inventor: Tommy Hall, 4617 Bennett St., Hope Mills, NC (US) 28348

( * ) Notice: Subject to any disclaimer, the term of this patent is extended or adjusted under 35 U.S.C. 154(b) by 0 days.

(21) Appl. No.: 09/573,519

(22) Filed: May 17, 2000

(51) Int. Cl.[7] ..... B05B 3/00

(52) U.S. Cl. ..... 239/754; 239/578; 239/722; 134/172

(58) Field of Search ..... 239/548, 589, 239/578, 722, 754, DIG. 6; 134/45, 123, 172; 15/320–323, 328, 354

(56) References Cited

U.S. PATENT DOCUMENTS

| | | | | |
|---|---|---|---|---|
| 3,652,014 | * | 3/1972 | Neville | 239/754 |
| 3,913,837 | * | 10/1975 | Grant | 239/754 X |
| 3,939,528 | | 2/1976 | Mossinsohn | 15/340 |
| 4,318,202 | | 3/1982 | Holman | 15/328 |
| 4,953,254 | | 9/1990 | Kohl et al. | 15/320 |
| 5,090,088 | | 2/1992 | Toth | 15/405 |
| 5,125,128 | | 6/1992 | Davis | 15/340 |
| 5,265,805 | * | 11/1993 | Artenian | 239/754 X |
| 5,319,828 | | 6/1994 | Waldhauser et al. | 15/320 |
| 5,503,091 | * | 4/1996 | Foster et al. | 239/754 X |
| 6,012,645 | * | 1/2000 | Poppitz | 239/754 X |

* cited by examiner

*Primary Examiner*—David A. Scherbel
*Assistant Examiner*—Steven J. Ganey
(74) *Attorney, Agent, or Firm*—Joseph N. Breaux

(57) ABSTRACT

A nozzle assembly connectable to a pressure washer water output line that is adapted for cleaning curbs. The curb cleaner nozzle assembly includes multiple nozzles that are oriented at different angles and are adjustable by the user to the desired orientation to most effectively clean a particular curb. The nozzle assembly is mounted onto a wheeled support structure to allow the nozzle assembly to be moved along the curb while supporting the nozzles at the correct orientation and spacing for optimal cleaning of the curb.

1 Claim, 1 Drawing Sheet

CURB CLEANER NOZZLE ASSEMBLY

TECHNICAL FIELD

The present invention relates to cleaning equipment and more particularly to a curb cleaner nozzle assembly that includes an adjustable height carriage assembly, a dual nozzle spray head assembly rotatably connected to an upper deck plate of the carriage assembly, and a flow control valve assembly with the valve body connected to the input of the input line of the dual nozzle spray head assembly and the spring loaded, valve control lever connected to the valve body with a shielded push/pull mechanical cable assembly; the adjustable height carriage assembly having a substantially planar upper deck plate, a handle assembly extending from a rear end upper surface of the upper deck plate and a number of wheel assemblies mounted to the upper deck plate in a manner to rollably support the upper deck plate; each wheel assembly including a height adjustment mechanism for allowing a user to adjust the height at which the wheel assembly supports the upper deck plate; the dual nozzle spray head assembly including a single input pipe mounted to nozzle orientation plate rotatably connected to an upper surface of the upper deck plate; the single input pipe being in fluid flow connection with a top nozzle supply pipe terminating in a top nozzle having a top discharge orifice and a side nozzle supply pipe terminating in a side nozzle have a side discharge orifice; the top nozzle and the side nozzle each being detachable, respectively, from the top nozzle supply pie and the side nozzle supply pipe; the top discharge orifice discharging water at a right angle to water discharged from the side discharge orifice; the nozzle orientation plate being lockable in a desired position with respect to the upper deck plate with a rotating base locking pin; the valve body having a flow control valve connected between a nozzle connector and a high pressure supply line connector; the nozzle connector being in fluid flow connection with the input pipe of the nozzle assembly; the flow control valve being controlled by the spring loaded, valve control lever; the spring loaded valve control lever being mounted on the handle; the spring loaded valve control lever being biased in a manner to move the spring loaded valve control lever away from the handle and to shut off flow through the flow control valve; the flow control valve being opened by squeezing the spring loaded valve control lever towards the handle.

BACKGROUND ART

Clean curbs greatly enhance the overall appearance of areas such as businesses, gardens, and the like. Although clean curbs are desirable, it can be difficult to quickly and easily clean them because curbs typically have multiple surfaces oriented at angles with respect to each other. It would be desirable, therefore, to have a curb cleaner that included multiple nozzles that were oriented at different angles and adjustable by the user to the desired orientation. Because maintaining the cleaning nozzles at the proper and distance can be difficult. It would be a further benefit to have a curb cleaner that included a wheeled support structure for supporting the nozzles at the correct orientation and spacing for optimal cleaning of the curb and that could be pushed along the curb to be cleaned.

GENERAL SUMMARY DISCUSSION OF INVENTION

It is thus an object of the invention to provide a curb cleaner nozzle assembly that includes an adjustable height carriage assembly, a dual nozzle spray head assembly rotatably connected to an upper deck plate of the carriage assembly, and a flow control valve assembly with the valve body connected to the input of the input line of the dual nozzle spray head assembly and the spring loaded, valve control lever connected to the valve body with a shielded push/pull mechanical cable assembly; the adjustable height carriage assembly having a substantially planar upper deck plate, a handle assembly extending from a rear end upper surface of the upper deck plate and a number of wheel assemblies mounted to the upper deck plate in a manner to rollably support the upper deck plate; each wheel assembly including a height adjustment mechanism for allowing a user to adjust the height at which the wheel assembly supports the upper deck plate; the dual nozzle spray head assembly including a single input pipe mounted to nozzle orientation plate rotatably connected to an upper surface of the upper deck plate; the single input pipe being in fluid flow connection with a top nozzle supply pipe terminating in a top nozzle having a top discharge orifice and a side nozzle supply pipe terminating in a side nozzle have a side discharge orifice; the top nozzle and the side nozzle each being detachable, respectively, from the top nozzle supply pie and the side nozzle supply pipe; the top discharge orifice discharging water at a right angle to water discharged from the side discharge orifice; the nozzle orientation plate being lockable in a desired position with respect to the upper deck plate with a rotating base locking pin; the valve body having a flow control valve connected between a nozzle connector and a high pressure supply line connector; the nozzle connector being in fluid flow connection with the input pipe of the nozzle assembly; the flow control valve being controlled by the spring loaded, valve control lever; the spring loaded valve control lever being mounted on the handle; the spring loaded valve control lever being biased in a manner to move the spring loaded valve control lever away from the handle and to shut off flow through the flow control valve; the flow control valve being opened by squeezing the spring loaded valve control lever towards the handle.

Accordingly, a curb cleaner nozzle assembly is provided. The curb cleaner nozzle assembly includes an adjustable height carriage assembly, a dual nozzle spray head assembly rotatably connected to an upper deck plate of the carriage assembly, and a flow control valve assembly with the valve body connected to the input of the input line of the dual nozzle spray head assembly and the spring loaded, valve control lever connected to the valve body with a shielded push/pull mechanical cable assembly; the adjustable height carriage assembly having a substantially planar upper deck plate, a handle assembly extending from a rear end upper surface of the upper deck plate and a number of wheel assemblies mounted to the upper deck plate in a manner to rollably support the upper deck plate; each wheel assembly including a height adjustment mechanism for allowing a user to adjust the height at which the wheel assembly supports the upper deck plate; the dual nozzle spray head assembly including a single input pipe mounted to nozzle orientation plate rotatably connected to an upper surface of the upper deck plate; the single input pipe being in fluid flow connection with a top nozzle supply pipe terminating in a top nozzle having a top discharge orifice and a side nozzle supply pipe terminating in a side nozzle have a side discharge orifice; the top nozzle and the side nozzle each being detachable, respectively, from the top nozzle supply pie and the side nozzle supply pipe; the top discharge orifice discharging water at a right angle to water discharged from the side discharge orifice; the nozzle orientation plate being lockable in a desired position with respect to the upper deck plate with a rotating base locking pin; the valve body having a flow control valve connected between a nozzle connector and a high pressure supply line connector; the nozzle connector being in fluid flow connection with the input pipe of the nozzle assembly; the flow control valve being controlled by the spring loaded, valve control lever; the spring loaded valve control lever being mounted on the handle; the spring loaded valve control lever being biased in a manner to move the spring loaded valve control lever away from the handle and to shut off flow through the flow control valve; the flow control valve being opened by squeezing the spring loaded valve control lever towards the handle.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
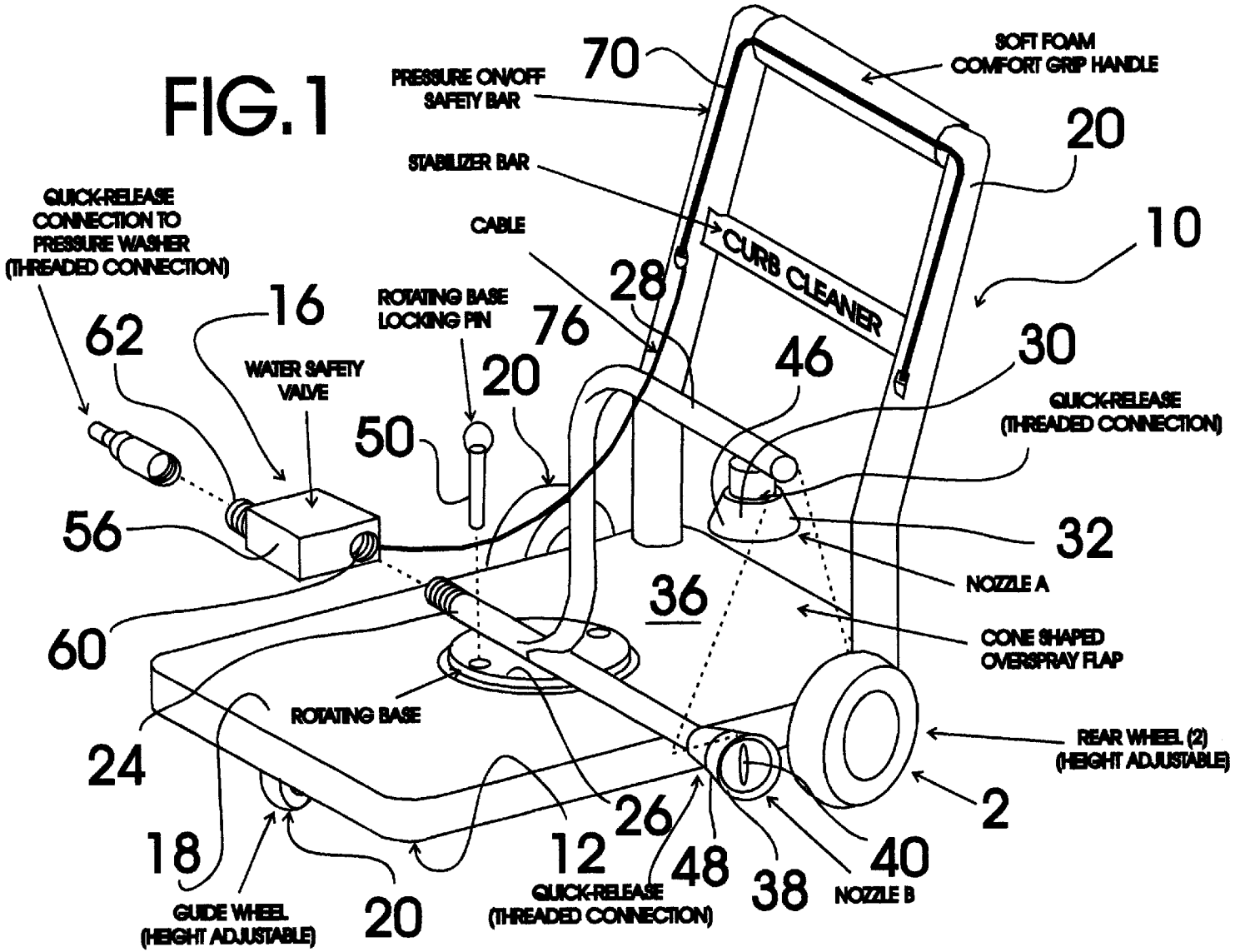
FIG. 1 is a perspective view of an exemplary embodiment of the curb cleaner nozzle assembly showing the adjustable height carriage assembly, the dual nozzle spray head assembly rotatably connected to an upper deck plate of the carriage assembly, and the flow control valve assembly with the valve body connected to the input of the input line of the dual nozzle spray head assembly and the spring loaded, valve control lever connected to the valve body with a shielded push/pull mechanical cable assembly; the adjustable height carriage assembly having a substantially planar upper deck plate, a handle assembly extending from a rear end upper surface of the upper deck plate and a number of wheel assemblies mounted to the upper deck plate in a manner to rollably support the upper deck plate; each wheel assembly including a height adjustment mechanism for allowing a user to adjust the height at which the wheel assembly supports the upper deck plate; the dual nozzle spray head assembly including a single input pipe mounted to nozzle orientation plate rotatably connected to an upper surface of the upper deck plate; the single input pipe being in fluid flow connection with a top nozzle supply pipe terminating in a top nozzle having a top discharge orifice and a side nozzle supply pipe terminating in a side nozzle have a side discharge orifice; the top nozzle and the side nozzle each being detachable, respectively, from the top nozzle supply pie and the side nozzle supply pipe; the top discharge orifice discharging water at a right angle to water discharged from the side discharge orifice; the nozzle orientation plate being lockable in a desired position with respect to the upper deck plate with a rotating base locking pin; the valve body having a flow control valve connected between a nozzle connector and a high pressure supply line connector; the nozzle connector being in fluid flow connection with the input pipe of the nozzle assembly; the flow control valve being controlled by the spring loaded, valve control lever; the spring loaded valve control lever being mounted on the handle; the spring loaded valve control lever being biased in a manner to move the spring loaded valve control lever away from the handle and to shut off flow through the flow control valve; the flow control valve being opened by squeezing the spring loaded valve control lever towards the handle.

FIG. 1 shows an exemplary embodiment of the curb cleaner nozzle assembly of the present invention generally designated 10. Curb cleaner nozzle assembly 10 includes an adjustable height carriage assembly, generally designated 12; a dual nozzle spray head assembly, generally designated 14; and a flow control valve assembly, generally designated 16.

Adjustable height carriage assembly 12 includes a heavy steel, substantially planar upper deck plate 18, a handle assembly 20 extending from a rear end upper surface of upper deck plate 18 three wheel assemblies 20 mounted to upper deck plate 18 in a manner to rollably support upper deck plate 18. Upper deck plate 18 is constructed from heavy steel to resist the forces generated from high pressure water exiting nozzle assembly 14. Each wheel assembly 20 includes a height adjustment mechanism for allowing a user to adjust the height at which wheel assemblies 20 support upper deck plate 18.

Dual nozzle spray head assembly 14 includes a single input pipe 24 mounted to nozzle orientation plate 26 rotatably connected to an upper surface of upper deck plate 18. Single input pipe 24 is in fluid flow connection with a top nozzle supply pipe 28 terminating in a top nozzle 30 having a top discharge orifice 32 and a side nozzle supply pipe 36 terminating in a side nozzle 38 have a side discharge orifice 40. Top nozzle 30 and side nozzle 38 are each detachable, respectively, from top nozzle supply pipe 28 and side nozzle supply pipe 36. Top discharge orifice 32 discharges water at a right angle to water discharged from side discharge orifice 40. Overspray guards 46,48 are provided to protect the operator from overspray. Nozzle orientation plate 26 is lockable in a desired fixed position with respect to upper deck plate 18 with a rotating base locking pin 50.

Valve body 16 has a flow control valve 56 connected between a nozzle connector 60 and a high pressure supply line connector 62. Nozzle connector 60 is connected in fluid flow connection with input pipe 24 of nozzle assembly 20 during assembly. Flow control valve 56 is controlled by a spring loaded, valve control lever 70 that is pivotally mounted to handle 20. Spring loaded valve control lever 70 is connected to flow control valve 56 by a shielded cable 76. Spring loaded valve control lever 70 is biased in a manner to move spring loaded valve control lever 70 away from handle 20 causing cable 76 to shut off flow through flow control valve 56. Flow control valve 56 is opened by squeezing spring loaded valve control lever 70 towards handle 20 which insures the operator is in control of curb cleaner nozzle assembly 10.

It can be seen from the preceding description that a curb cleaner nozzle assembly has been provided.

It is noted that the embodiment of the curb cleaner nozzle assembly described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A curb cleaner nozzle assembly comprising:

an adjustable height carriage assembly;

a dual nozzle spray head assembly rotatably connected to an upper deck plate of said carriage assembly; and a flow control valve assembly with a valve body connected to said input of an input line of said dual nozzle spray head assembly and a spring loaded, valve control lever connected to said valve body with a shielded push/pull mechanical cable assembly;

said adjustable height carriage assembly having a substantially planar upper deck plate, a handle assembly extending from a rear end upper surface of said upper deck plate and a number of wheel assemblies mounted to said upper deck plate in a manner to rollably support said upper deck plate;

each wheel assembly including a height adjustment mechanism for allowing a user to adjust said height at which said wheel assembly supports said upper deck plate;

said dual nozzle spray head assembly including a single input pipe mounted to a nozzle orientation plate rotatably connected to an upper surface of said upper deck plate;

said single input pipe being in fluid flow connection with a top nozzle supply pipe terminating in a top nozzle having a top discharge orifice and a side nozzle supply pipe terminating in a side nozzle have a side discharge orifice;

said top nozzle and said side nozzle each being detachable, respectively, from said top nozzle supply pipe and said side nozzle supply pipe;

said top discharge orifice discharging water at a right angle to water discharged from said side discharge orifice;

said nozzle orientation plate being lockable in a desired position with respect to said upper deck plate with a rotating base locking pin;

said valve body having a flow control valve connected between a nozzle connector and a high pressure supply line connector;

said nozzle connector being in fluid flow connection with said input pipe of said nozzle assembly;

said flow control valve being controlled by said spring loaded, valve control lever;

said spring loaded valve control lever being mounted on said handle;

said spring loaded valve control lever being biased in a manner to move said spring loaded valve control lever away from said handle and to shut off flow through said flow control valve;

said flow control valve being opened by squeezing said spring loaded valve control lever towards said handle.

* * * * *